US007810769B2

(12) United States Patent
Williams

(10) Patent No.: US 7,810,769 B2
(45) Date of Patent: Oct. 12, 2010

(54) ROLLER FOOT FOR AN ARTICLE OF FURNITURE

(75) Inventor: Scott J. Williams, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 541 days.

(21) Appl. No.: 11/463,143

(22) Filed: Aug. 8, 2006

(65) Prior Publication Data

US 2008/0042023 A1 Feb. 21, 2008

(51) Int. Cl.
*F16M 11/20* (2006.01)

(52) U.S. Cl. ..... 248/188.1

(58) Field of Classification Search ..... 248/188.1, 248/129, 128, 98, 188.9; 108/177, 189; 312/351.11–351.14
See application file for complete search history.

(56) References Cited

U.S. PATENT DOCUMENTS

| | | | | |
|---|---|---|---|---|
| 1,064,244 | A | | 6/1913 | Neugebauer |
| 1,137,329 | A | | 4/1915 | Johnson |
| 1,152,687 | A | | 9/1915 | Acton |
| 1,749,751 | A | | 3/1930 | Bergsten |
| 1,873,347 | A | | 8/1932 | Smart |
| 2,025,448 | A | | 12/1935 | Hebbinghaus |
| 2,059,420 | A | | 11/1936 | Ward, Jr. |
| 2,434,863 | A | | 1/1948 | Parkhill |
| 2,613,389 | A | | 10/1952 | Cramer |
| 2,709,827 | A | | 6/1955 | Volz |
| 2,767,420 | A | | 10/1956 | Riccio |
| 2,770,831 | A | | 11/1956 | Angelica et al. |
| 2,808,607 | A | | 10/1957 | Urso |
| 2,885,720 | A | | 5/1959 | Bertha |
| 2,911,226 | A | | 11/1959 | Grieder |
| 2,942,290 | A | | 6/1960 | Segal |
| 2,942,698 | A | | 6/1960 | Bolinger |
| 2,980,944 | A | | 4/1961 | Bolinger |
| 3,025,930 | A | | 3/1962 | Segal |
| 3,069,719 | A | * | 12/1962 | Ridge ..... 16/30 |
| 3,102,298 | A | | 9/1963 | Sheahan |
| 3,349,425 | A | | 10/1967 | Rabelos |
| 3,617,023 | A | * | 11/1971 | Schneiderman ..... 248/188.7 |

(Continued)

FOREIGN PATENT DOCUMENTS

| | | | |
|---|---|---|---|
| GB | 2127287 | | 4/1984 |
| GB | 2127287 | A * | 4/1984 |
| JP | 03266702 | | 11/1991 |

*Primary Examiner*—J. Allen Shriver, II
*Assistant Examiner*—Erin Smith
(74) *Attorney, Agent, or Firm*—Andrus, Sceales, Starke & Sawall, LLP

(57) ABSTRACT

A wheel-type support for an article of furniture includes a laterally extending support member defining an outwardly facing end opening and a downwardly facing recess spaced inwardly from the end opening. A wheel is positioned within the downwardly facing recess, and a wheel retainer arrangement is secured to the support member at the outwardly facing end opening. The wheel is rotatably supported by the wheel retainer arrangement. The wheel includes a central passage, and the wheel retainer arrangement includes an axle that extends through the central passage such that the wheel is rotatable on the axle. The wheel retainer arrangement also includes an axle retainer that fixes the axle on either side of the wheel, and an end member that is secured to the support member over the outwardly facing end opening.

5 Claims, 4 Drawing Sheets

U.S. PATENT DOCUMENTS 3,699,609 A 10/1972 Spatz
3,796,169 A 3/1974 Bales et al.
4,077,086 A 3/1978 Butler
4,086,680 A 5/1978 Kelly
4,102,172 A 7/1978 Iiyoshi
4,166,516 A 9/1979 Thurmond, Jr.
4,700,430 A 10/1987 Raftery
4,821,369 A 4/1989 Daniels
5,001,808 A 3/1991 Chung
5,109,798 A * 5/1992 Impastato et al. ..... 119/51.03
5,136,751 A * 8/1992 Coyne et al. ..... 16/29
5,259,088 A 11/1993 Yang
5,355,550 A 10/1994 Yang
5,421,636 A 6/1995 Gamble
5,551,712 A 9/1996 Repucci
5,568,671 A * 10/1996 Harris et al. ..... 16/18 R
5,617,934 A 4/1997 Yang
5,749,121 A * 5/1998 Loescher ..... 16/43
6,357,077 B1 3/2002 Jones et al.
6,473,935 B1 11/2002 Cherukuri
D471,791 S 3/2003 Bosman
D488,998 S 4/2004 Bosman
6,719,256 B2 4/2004 Rydell et al.
6,883,763 B2 4/2005 Bosman et al.

* cited by examiner

ROLLER FOOT FOR AN ARTICLE OF FURNITURE

BACKGROUND AND SUMMARY OF THE INVENTION

This invention relates to a support for an article of furniture, and more particularly to a roller-type furniture support.

Various forms of furniture supports are known, some of which include rollers for facilitating movement of an article of furniture on a support surface such as a floor. A typical wheeled or roller-type furniture support is in the form of a caster that includes a stem, which is received within a downwardly facing passage formed in a leg or other component of the article of furniture. The stem extends upwardly from a bracket, and a roller or wheel is rotatably mounted to the bracket. A furniture support of this type is well suited for many applications, e.g. for an article of furniture such as a chair, which has vertically-extending legs and in which a certain amount of clearance between the lower end of the leg and the floor is either desirable or acceptable. This type of support is not particularly well suited for applications in which the article of furniture includes a laterally or horizontally extending support member adjacent the floor, and/or those applications in which a relatively small degree of clearance between the floor and the furniture support is required.

It is an object of the present invention to provide a wheeled or roller-type furniture support that is well suited for an article of furniture that has a laterally or horizontally extending support member adjacent the support surface, such as a floor. It is another object of the invention to provide such a furniture support that provides a relatively small degree of clearance between the furniture support member and the support surface, which is especially well suited for low profile furniture supports. A further object of the invention is to provide such a furniture support that is capable of blending with the exterior of the furniture support member, so as not to detract from the overall design or aesthetic of the furniture support member. Yet another object of the invention is to provide such a furniture support which involves relatively few components and which can be easily and quickly assembled to the furniture support member.

In accordance with the present invention, a wheeled or roller-type support for an article of furniture includes a laterally extending support member defining an outwardly facing end opening and a downwardly facing recess spaced inwardly from the end opening. A wheel or roller is positioned within the downwardly facing recess, and a wheel retainer arrangement is secured to the support member at the outwardly facing end opening. The wheel or roller is rotatably supported by the wheel retainer arrangement. The wheel preferably includes a central laterally extending passage, and the wheel retainer arrangement includes an axle member that extends through the central passage such that the wheel is rotatable on the axle member. The wheel retainer arrangement also preferably includes an axle retainer that fixes the axle member in a pair of locations on either side of the wheel, and an end member that is secured to the support member over the outwardly facing end opening.

The axle retainer may be in the form of an axle bracket defining a pair of spaced apart walls and a space within which the wheel is located. The axle bracket is received within a passage that extends inwardly from the open end area of the support member, and the axle is engaged with the pair of spaced apart walls of the axle bracket to fix the axle member on either side of the wheel. The support member may include a lower wall having an open area which at least partially defines the downwardly facing recess. A lower edge defined by each of the pair of walls of the axle bracket includes an axle opening facing the lower wall of the support member, and the support member lower wall functions to maintain the axle member in each axle opening when the axle bracket is received within the passage of the support member. The axle bracket may be secured to the lower wall of the support member via a fastener that extends between and is engaged with the axle bracket and the lower wall of the support member.

The support member may include a laterally extending interior wall, and the end member may be secured to the laterally extending interior wall to maintain the end member in position over the end opening of the laterally extending support member. The lower wall of the support member includes an opening, and the end member is secured to the interior wall of the support member via a fastener that is inserted through the opening of the support member and is engaged with the end member and the interior wall of the support member.

The invention also contemplates a method of mounting a wheel to a furniture support, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
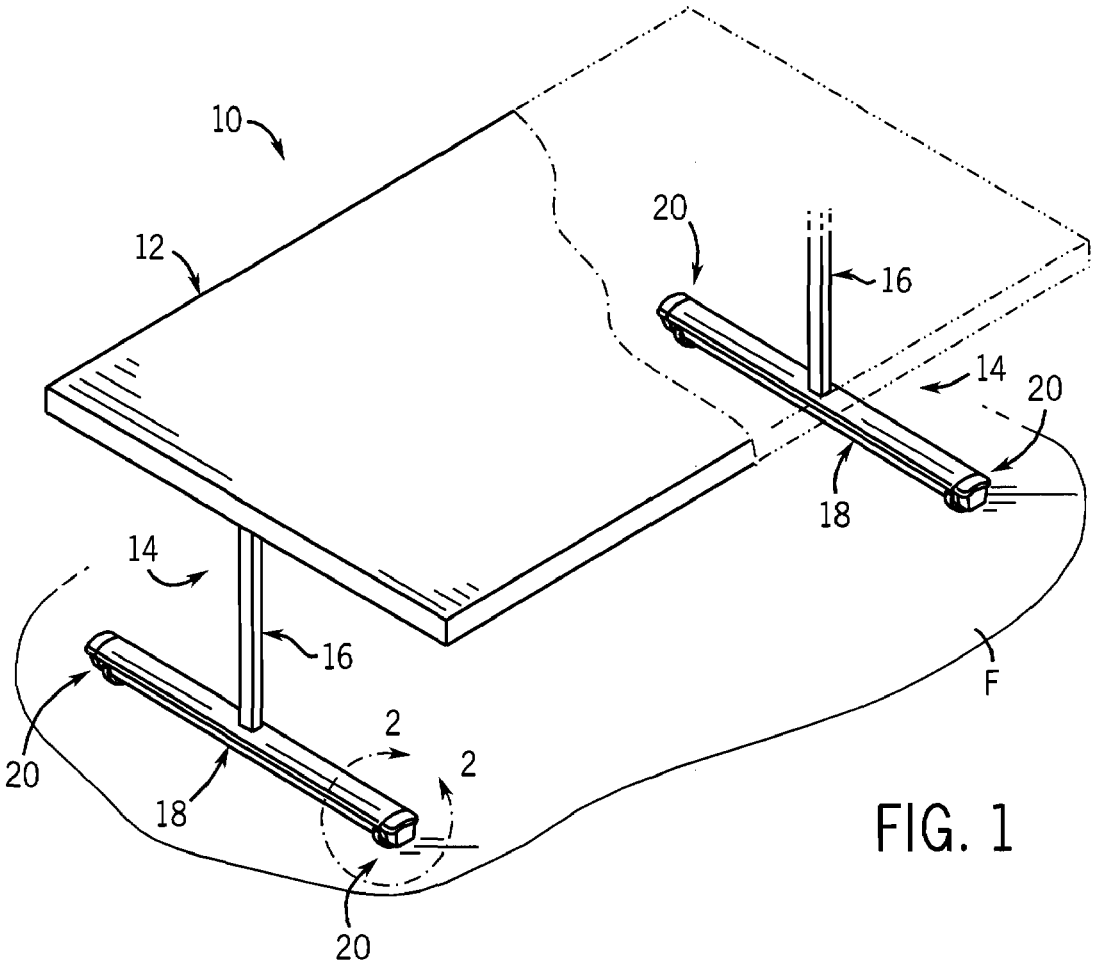
FIG. 1 is an isometric view of an article of furniture, in the form of a table, incorporating a wheeled or roller-type support in accordance with the present invention.

FIG. 1 illustrates a representative article of furniture, in the form of a table 10, which incorporates the wheeled or roller-type furniture support in accordance with the present invention. Table 10 includes a table top 12 and a pair of end supports 14 that function to support table top 12 above a support surface, such as a floor F. End supports 14 are similarly constructed, and each is in the form of an inverted T-shaped support including an upright support member 16 connected at its upper end to the underside of table top 12, and connected at its lower end to a horizontal or laterally-extending support member 18. A wheeled or roller-type support 20, in accordance with the present invention, is engaged at each end of laterally extending support member 18, for enabling table 10 to be moved on floor F.

It is understood that table 10 is representative of any type of article of furniture in connection with which roller-type support 20 of the present invention may be used. Roller-type support 20 may be incorporated in any type of furniture other than a table, e.g. a chair, bench, desk, stool, etc., which includes a laterally extending support member located adjacent the floor.

Figure 2:
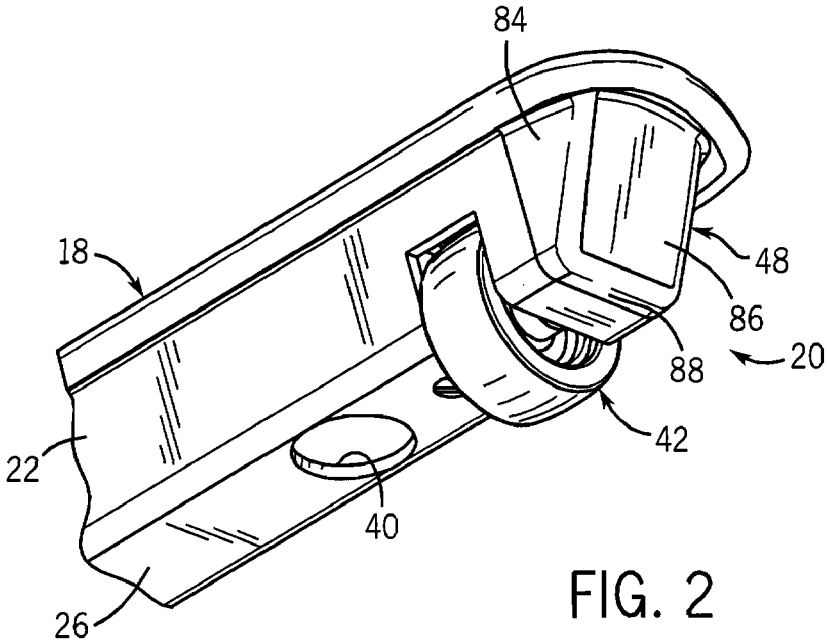
FIG. 2 is an enlarged partial isometric view with reference to line 2-2 of FIG. 1, showing the roller-type support of the present invention.
Figure 3:
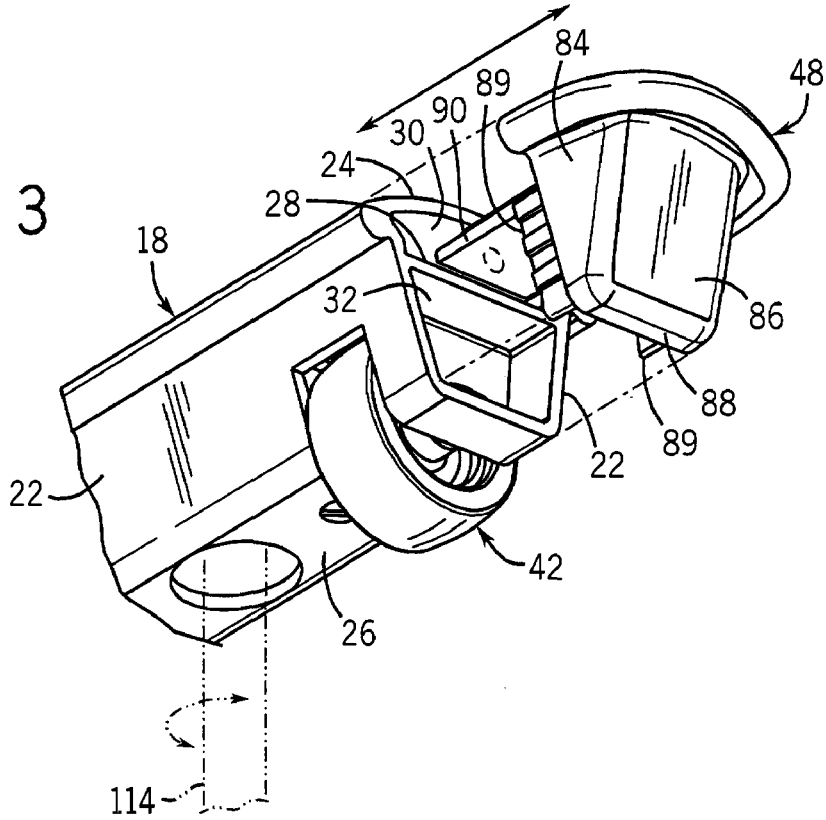
FIG. 3 is a view similar to FIG. 2, showing removal of an end member incorporated in the roller-type support of the present invention.
Figure 4:
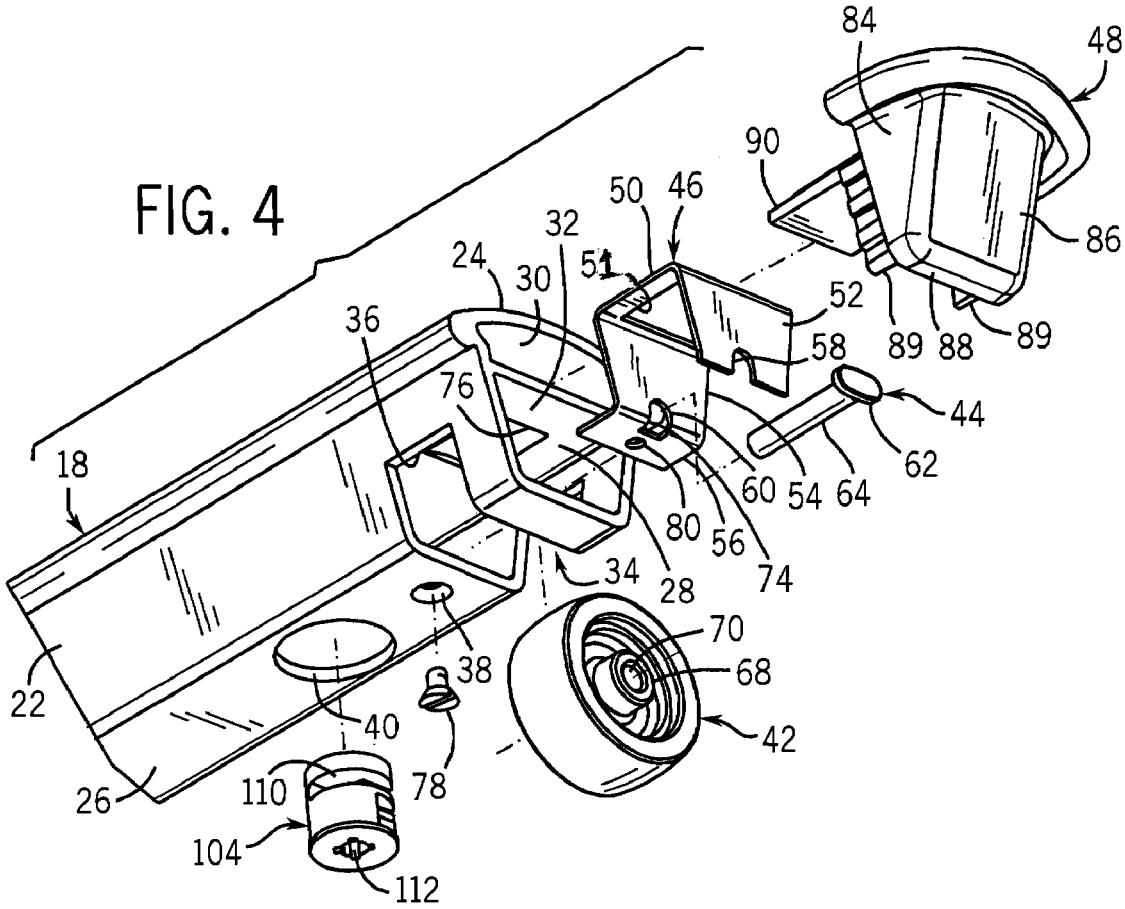
FIG. 4 is a bottom exploded isometric view of the roller-type support of FIGS. 1-3.
Figure 5:
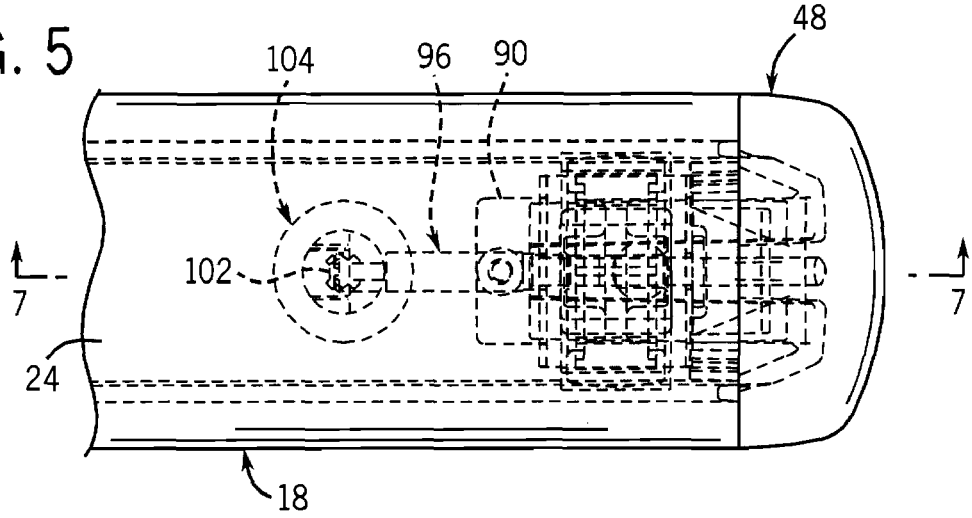
FIG. 5 is a top plan view of the roller-type support of FIGS. 1-4.
Figure 6:
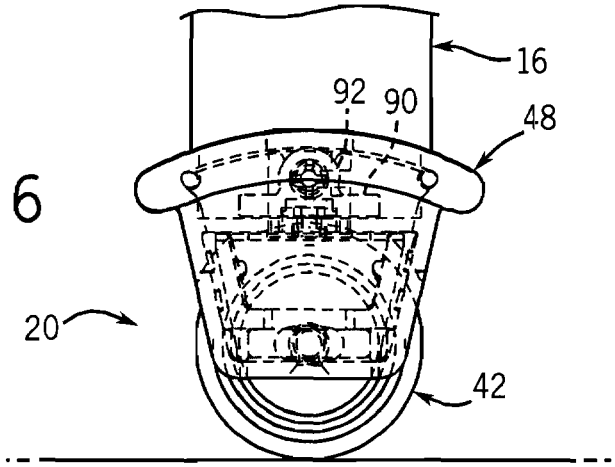
FIG. 6 is an end elevation view of the roller-type support of FIGS. 1-5.
Figure 7:
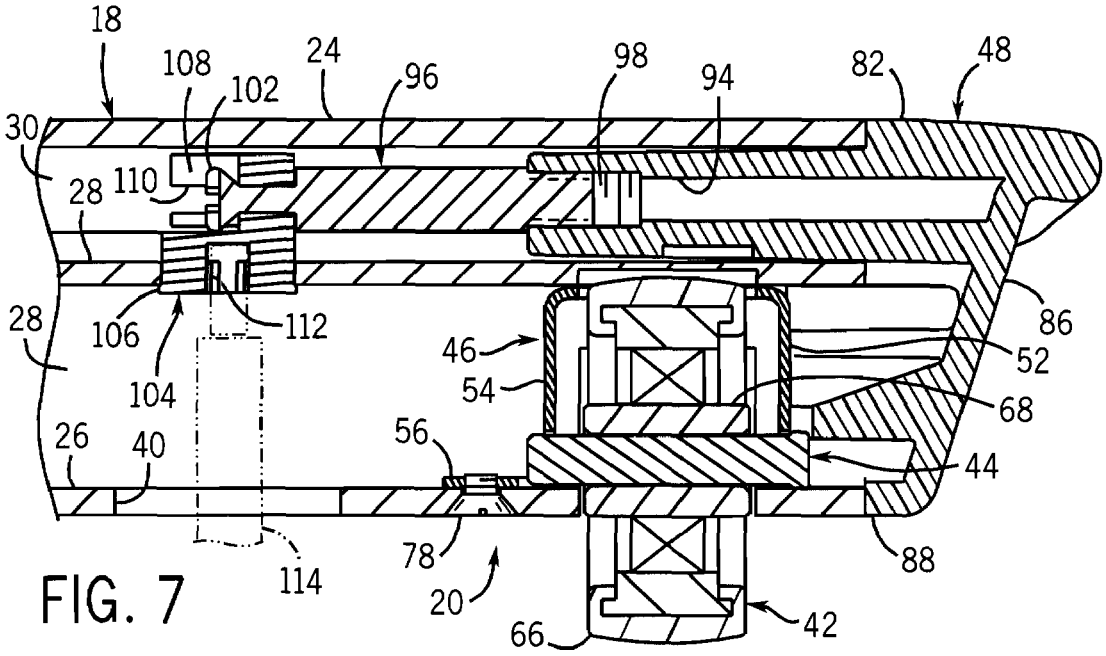
FIG. 7 is a section view taken along line 7-7 of FIG. 5.

Referring to FIGS. 2-4, laterally extending support member 18 of end support 14 includes a pair of side walls 22, a top wall 24, a bottom wall 26 and a transverse interior wall 28. Representatively, laterally extending support member 18 may be formed of a metallic material such as aluminum in an extrusion process, although it is understood that any other satisfactory material and forming process may be employed.

Laterally extending support member 18 defines a laterally-facing open end at which side walls 22, top wall 24, bottom wall 26 and interior wall 28 terminate. The interior of laterally extending support member 18 is divided by interior wall 28 into an upper, laterally extending passage 30 and a lower, laterally extending passage 32, both of which extend inwardly from the open end of laterally extending support member 18.

A downwardly facing recess or slot 34 is formed in side walls 22 and bottom wall 26 of support member 18. Slot 34 extends across the entire width of bottom wall 26, and encompasses a lower portion of each side wall 22. The end edges of slot 34, shown at 36, are located below interior wall 28, such that slot 34 communicates between the exterior of support member 18 and lower passage 32 of support member 18. A portion of lower wall 26 and side walls 22 is disposed between the outer edge of slot 34 and the laterally facing open end of support member 18.

A countersunk fastener opening 38 is formed in lower wall 26 of support member 18 inwardly of the inner edge of slot 34. An access opening 40 is formed in bottom wall 26 of support member 18 inwardly of fastener opening 38.

Roller-type support 20 includes a wheel or roller 42, an axle 44, an axle support in the form of an axle bracket 46, and an end member 48. In a manner to be explained, these components are configured to be engaged with support member 18 to facilitate movement of table 10 on floor F using wheel or roller 42.

Axle bracket 46 includes a top wall 50 within which an opening 51 is formed, an outer side wall 52, an inner side wall 54, and a mounting tab 56 extending from the lower end of inner side wall 54. Outer and inner side walls 52, 54, respectively, are similarly formed, and include respective downwardly facing notches 58, 60, which extend upwardly from the lower edges of respective side walls 52, 54. Axle 44 includes a head 62 and a shank 64, which has a length slightly greater than the space between axle bracket side walls 52, 54.

Roller 42 includes an outer peripheral floor-engaging rim section 66 and a central hub section 68 that defines a laterally extending central hub passage 70. A pair of washers 72 are located adjacent the ends of hub section 68. The shank 64 of axle 44 is received within notches 58, 60 in side walls 52, 54, respectively, and extends through hub passage 70 and through washers 72. The head 62 of axle 44 engages the area of outer side wall 52 adjacent notch 58 to maintain the axial position of axle 44, and the end of axle shank 64 is received within a recess 74 in mounting tab 56, which communicates with notch 60 in side wall 54. The outer rim section 66 of roller 42 extends through opening 51 in axle bracket top wall 50, and through an aligned opening 76 formed in interior wall 28 of support member 18.

Axle bracket 46 is configured to span across slot 34, so as to support roller 42 for rotation within slot 34 on axle 44. The inner area of axle bracket 46 is maintained in position within lower passage 32 of support member 18 via a fastener, such as a screw 78. The threaded shank of screw 78 extends through fastener opening 38 and into engagement with an opening 80 in mounting tab 56, which is aligned with fastener opening 38 when axle bracket 46 is received within lower passage 32 of support member 18. Axle bracket 46 is configured such that, when secured to support member 18 in this manner, inner side wall 54 is located slightly inwardly of the inner edge of slot 34 and outer side wall 52 is located slightly outwardly of the outer edge of slot 34. The inner surface of support member bottom wall 26 cooperates with notches 58, 60 in axle bracket side walls 52, 54, respectively, to maintain engagement of axle bracket side wills 52, 54 with axle shank 64 in spaced locations on opposite sides of roller 42.

End member 48 defines an upper wall 82, a pair of side walls 84, an end wall 86 and a bottom wall 88. Upper wall 82, side walls 84 and bottom wall 88 have a cross section that matches that of the open end of support member 18 such that, when end member 48 is secured to the open end of support member 18, end member 48 essentially acts as a continuation of support member 18 to close the open end of support member 18. End member 48 further includes a pair of guide walls 89, each of which extends inwardly from the inner edge of one of side walls 84. In addition, end member 48 includes an inwardly extending mounting tongue 90 having an inwardly extending barrel 92, which together are configured to be received within upper passage 30 of support member 18. Barrel 92 defines an inwardly open passage 94, the inner end of which is threaded. An end member connector 96 defines a shouldered outer end from which a threaded section 98 extends. At its opposite end, connector 96 defines a neck 100 and a head 102. Threaded section 98 of connector 96 is engaged with the threaded inner end of passage 94 in barrel 92, such that the shoulder of connector 96 engages the end of barrel 92. With this construction, connector 96 extends inwardly within upper passage 30 such that head 102 is located in vertical alignment over access opening 40 in support member lower wall 26.

Figure 8:
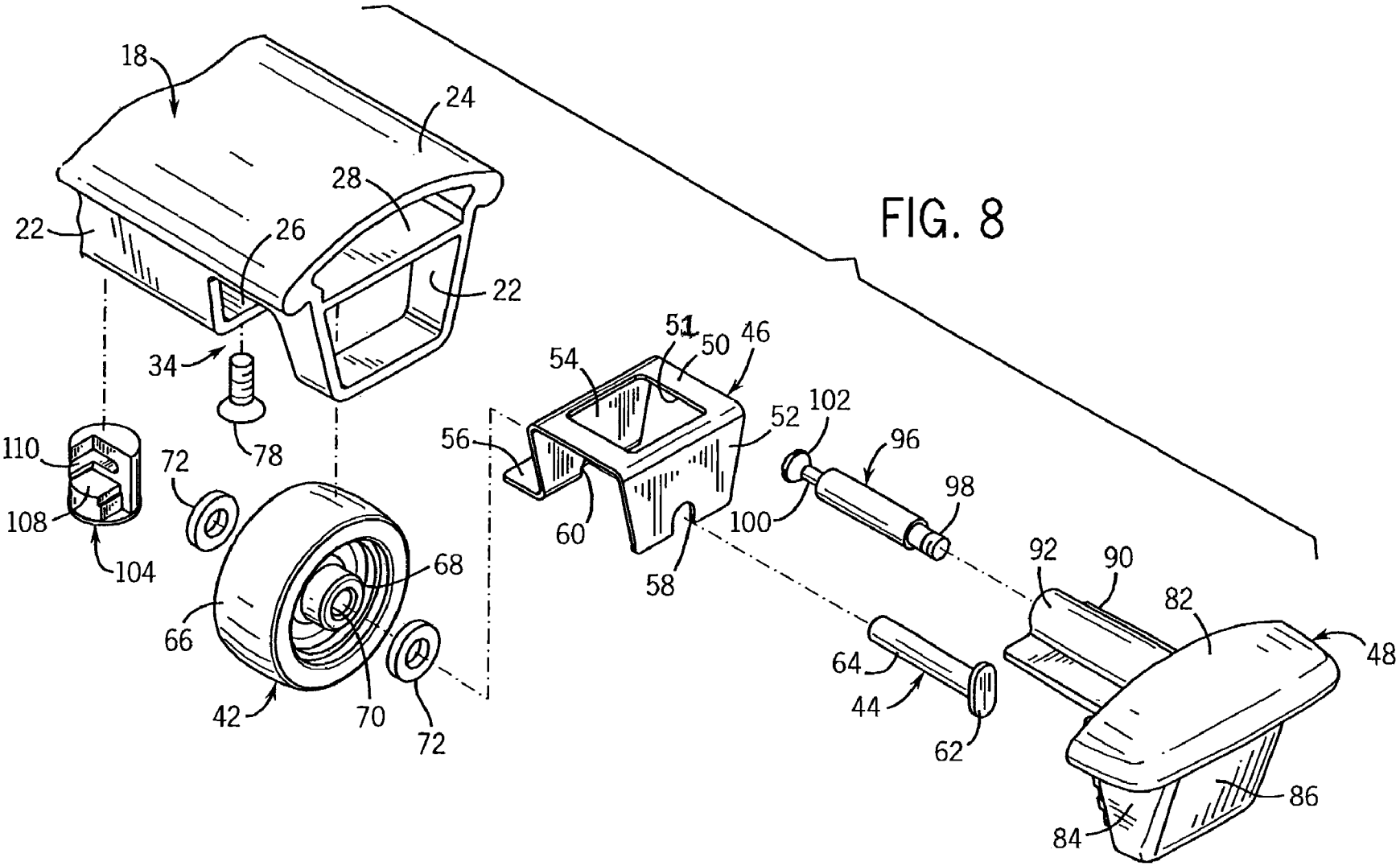
FIG. 8 is a top exploded isometric view of the roller-type support of FIGS. 1-7.

A threaded lock member 104 is engaged within a threaded opening 106 in interior wall 28 of support member 18, which is in vertical alignment with access opening 40 in lower wall 26. As shown in FIG. 8, the upper end of lock member 104 includes a recessed area 108. The upper portion of lock member 104 includes a laterally open slot 110 that extends outwardly from recessed area 108 and opens onto the outer surface of the upper portion of lock member 104. Lock member 104 further includes a vertically extending noncircular driver passage 112 that extends upwardly from the lower surface of lock member 104. Driver passage 112 is configured to receive the upper, driving end of a rotary driving tool, representatively shown at 114.

In assembly, roller-type support 20 is assembled to the end of support member 18 by first inserting axle bracket 46 into lower passage 32 of support member 18 such that opening 80 in mounting tab 56 is in alignment with fastener opening 38 in bottom wall 26 of support member 18. Screw 78 is then passed through fastener passage 38 and into engagement with opening 80, to fix the inner area of axle bracket 46. Washers 72 are then positioned on opposite sides of hub section 68 of roller 42, which is then positioned in alignment with notches 58 and 60 in axle bracket side walls 52, 54, respectively. Axle 44 is inserted through outer notch 58 and central hub passage 70 and through washers 72, such that the inner end of axle shank 64 is received within notch 60 and recess 74. When axle 44 is inserted in this manner, head 62 of axle 44 engages the outwardly facing surface of side wall 52 adjacent notch 58.

Axle 44 thus serves to rotatably mount roller 42 within slot 34 between axle bracket side walls 52, 54, respectively. Connector 96 is then engaged with barrel 92 of end member 48 as described above, and end member 48 is advanced toward the open end of support member 18 such that tongue 90 and barrel 92 are received within upper passage 30 of support member 18. Guide walls 89 are engaged within the outer areas of lower passage 32 adjacent the facing inside surfaces of side walls 22. Before end member 48 and connector 96 are fully advanced relative to support member 18, lock member 104 is engaged with threaded opening 106 in interior wall 28 such that recessed area 108 of lock member 104 is positioned to receive head 102 of connector 96. Once end member 48 and connector 96 are fully advanced relative to support member 18, such that head 102 is received within recessed area 108 of lock member 104 and the facing surfaces of end member 48 engage the end surfaces of support member 18, lock member 104 is turned by operation of driving tool 114 so as to engage neck 100 of connector 96 within slot 110 of lock member 104. Head 102 of connector 96 remains within recessed area 110 of lock member 104 when lock member 104 is turned in this manner, and engagement of head 102 with lock member 104 adjacent slot 110 functions to prevent outward movement of connector 96, and thereby end member 48, relative to support member 18. When end member 48 is secured to the outer end of support member 18 in this manner, an internal bumper wall of end member 48 engages the outer surface of axle head 62, so as to maintain axle 44 in position between axle side walls 52, 54. With this construction, end member 48 can be removed if necessary so as to enable disassembly of roller-type support 20, such as for replacement of roller 42 or for any other reason. Roller-type support 20 can then subsequently be reassembled as set forth above in the field, with little time and using conventional tools.

While the invention has been shown and described with respect to a specific embodiment, it is contemplated that various alternatives and modifications are possible and are contemplated as being within the scope of the present invention. For example, and without limitation, the overall shape of support member 18 may vary from that which is shown and described. Axle bracket 46 may be secured to the support member using a fastener such as 78 or in any other satisfactory manner. It is also contemplated that both sides of axle bracket 46 may be secured to the support member, as opposed to the one side of axle bracket 46 as shown and described. In addition, axle 44 may be maintained in position across slot 34 in a manner other than by use of axle bracket 46. End member 48 may simply serve the function of closing the open end of support member 18, without interfacing with the axle mounting components of support 20.

Various alternatives and embodiments are contemplated as being within the scope of the following claims particularly pointing out and distinctly claiming the subject matter regarded as the invention.

I claim:

1. A support for an article of furniture, comprising:

a laterally extending support member defining an outwardly facing end opening and a downwardly facing recess spaced inwardly from the end opening;

a wheel positioned within the downwardly facing recess;

a wheel retainer arrangement secured to the support member at the outwardly facing end opening, wherein the wheel is rotatably and removably supported by the wheel retainer arrangement; and an end member secured to the support member over the outwardly facing end opening, wherein the wheel includes a central laterally extending passage, and wherein the wheel retainer arrangement includes a removable axle member having an elongated shank with a smooth surface through its length that extends through the central passage, wherein the wheel is rotatable on the axle member and the axle member is slidable into and out of a position along a lower wall of the support member to expedite assembly and disassembly of the wheel and the axle separately relative to the support member, wherein the wheel retainer arrangement further includes an axle retainer that fixes the axle member in a pair of locations on either side of the wheel, the axle retainer comprising an axle bracket defining a pair of spaced apart walls and a space within which the wheel is located, wherein the axle bracket is received within a passage extending inwardly from the open end area of the support member and the axle member is engaged with the pair of spaced apart walls of the axle bracket to fix the axle member in the pair of locations on either side of the wheel, wherein the axle bracket is secured to the lower wall of the support member via a fastener that extends between and is engaged with the axle bracket and the lower wall of the support member.

2. The support of claim 1, wherein the support member includes a lower wall that has an open area which at least partially defines the downwardly facing recess, and wherein a lower edge defined by each of the pair of walls of the axle bracket includes an axle opening facing the lower wall of the support member, wherein the support member lower wall functions to maintain the axle member in each axle opening when the axle bracket is received within the passage of the support member.

3. A roller-type furniture support, comprising:

a laterally-extending support member defining an open end area and a downwardly facing recess, wherein the support member includes a laterally extending passage extending inwardly from the open end area to the downwardly facing recess;

a wheel located within the downwardly facing recess; and support means engaged with the wheel and secured to the support member such that the wheel is rotatably and removably supported relative to the support member and the support means;

an end member secured to the support member over the open end area, wherein the wheel includes a laterally extending central passage, and wherein the support means includes a removable axle provided with an unthreaded shank extending through the central passage of the wheel and the axle is slidable into and out of a position along a lower wall of the support member having an open area defining the downwardly facing recess to enable assembly and disassembly of the wheel separately relative to the support means and the support member, wherein the support means includes an axle retainer located within the support member passage and engaged with the axle, wherein the axle retainer is secured to the support member for maintaining the position of the axle retainer within the laterally extending passage, wherein the end member is configured to at least partially maintain the position of the axle retainer within the laterally extending passage.

4. A support for an article of furniture, comprising:

a laterally extending support member defining an outwardly facing end opening and a downwardly facing recess spaced inwardly from the end opening;

a wheel positioned within the downwardly facing recess;

a wheel retainer arrangement secured to the support member at the outwardly facing end opening, wherein the wheel is rotatably and removably supported by the wheel retainer arrangement, and an end member secured to the support member over the outwardly facing end opening, wherein the wheel includes a central laterally extending passage, and wherein the wheel retainer arrangement includes a removable axle member having an elongated shank with a smooth surface through its length that extends through the central passage, wherein the wheel is rotatable on the axle member and the axle member is slidable into and out of a position along a lower wall of the support member to expedite assembly and disassembly of the wheel and the axle separately relative to the support member, wherein the wheel retainer arrangement further includes an axle retainer that fixes the axle member in a pair of locations on either side of the wheel, the axle retainer comprising an axle bracket defining a pair of spaced apart walls and a space within which the wheel is located, wherein the axle bracket is received within a passage extending inwardly from the open end area of the support member and the axle member is engaged with the pair of spaced apart walls of the axle bracket to fix the axle member in the pair of locations on either side of the wheel, wherein the laterally extending support member further includes a laterally extending interior wall, and wherein the end member is secured to the laterally extending interior wall to maintain the end member in position over the end opening of the laterally extending support member, wherein the lower wall of the support member includes an opening, and wherein the end member is secured to the interior wall of the support member via a fastener that is inserted through the opening of the support member and engaged with the end member and the interior wall of the support member.

5. A roller-type furniture support, comprising:

a laterally-extending support member defining an open end area and a downwardly facing recess, wherein the support member includes a laterally extending passage extending inwardly from the open end area to the downwardly facing recess;

a wheel located within the downwardly facing recess, the wheel including a laterally extending central passage;

support means engaged with the wheel and secured to the support member such that the wheel is rotatably and removably supported relative to the support member and the support means; and an end member secured to the support member over the open end area, wherein the support means includes a removable axle provided with an unthreaded shank extending through the central passage of the wheel and the axle is slidable into and out of a position along a lower wall of the support member defining the downwardly facing recess to enable assembly and disassembly of the wheel separately relative to the support means and the support member, wherein the support means further includes an axle retainer located within the support member passage and engaged with the axle, wherein the axle retainer is secured to the support member for maintaining the position of the axle retainer within the laterally extending passage, wherein the support member includes an interior wall which at least partially defines the laterally extending passage, and wherein the end member is secured to the interior wall to maintain the end member in position over the open end area, wherein the end member is secured to the interior wall of the support member via a fastener that is inserted through the opening of the support member and engaged with the end member and the interior wall of the support member.

* * * * *